US010039994B2

(12) United States Patent
Ferrer-Walsh

(10) Patent No.: US 10,039,994 B2
(45) Date of Patent: Aug. 7, 2018

(54) CRACKER WITH VIEWING WINDOW

(71) Applicant: Willow Group, Ltd., Batavia, NY (US)

(72) Inventor: Eudalda Ferrer-Walsh, Batavia, NY (US)

(73) Assignee: Willow Group, Ltd., Batavia, NY (US)

( * ) Notice: Subject to any disclaimer, the term of this patent is extended or adjusted under 35 U.S.C. 154(b) by 0 days.

(21) Appl. No.: 15/019,539

(22) Filed: Feb. 9, 2016

(65) Prior Publication Data

US 2017/0225092 A1 Aug. 10, 2017

(51) Int. Cl.
*A63H 37/00* (2006.01)

(52) U.S. Cl.
CPC ..... *A63H 37/00* (2013.01)

(58) Field of Classification Search
CPC ..... A63H 37/00
USPC ..... 446/398, 475, 397
See application file for complete search history.

(56) References Cited

U.S. PATENT DOCUMENTS 825,843 A * 7/1906 Kliemandt ..... A63H 5/00 102/357
1,290,300 A * 1/1919 Nortier ..... A63H 5/00 446/398
1,377,741 A * 5/1921 Woolhiser ..... A63H 37/00 446/398
2,142,894 A * 1/1939 Grigg ..... A63H 37/00 156/197
2,149,852 A * 3/1939 Montague ..... A63H 37/00 446/398
2,787,862 A * 4/1957 Hoeflich ..... A63H 37/00 206/457
3,744,417 A * 7/1973 Kaneko ..... A63H 37/00 102/357
4,285,158 A 8/1981 Courts et al.
4,683,588 A 7/1987 Goldberg
4,806,909 A 2/1989 Arcand
5,338,242 A * 8/1994 Cheng ..... A63H 37/00 446/183
5,538,451 A 7/1996 Sherer
5,582,532 A * 12/1996 Tucker ..... A63H 37/00 239/226
5,830,037 A 11/1998 Mastandrea, Jr.
6,299,502 B1 * 10/2001 Cheng ..... A63H 37/00 446/183
6,368,176 B1 4/2002 Lozowski et al.
6,368,177 B1 4/2002 Gabai
(Continued)

FOREIGN PATENT DOCUMENTS

GB 1562815 A 3/1980
GB 2243306 A 10/1991
(Continued)

*Primary Examiner* — Alexander Niconovich
(74) *Attorney, Agent, or Firm* — Harter Secrest & Emery LLP; Brian B. Shaw, Esq.

(57) ABSTRACT

A cracker including a central body, and a pair of opposing pull-formations frangibly connected to opposite ends of the central body. A window is disposed within the central body and is adapted for viewing contents of the cracker prior to opening or fracture of the cracker. A window frame and the central body are constructed to sufficiently resist deformation or failure such that longitudinal opening force applied to the cracker results in the separation of a pull-formation prior to deformation or destruction of the central body.

9 Claims, 5 Drawing Sheets

(56) References Cited

U.S. PATENT DOCUMENTS

| | | | | |
|---|---|---|---|---|
| 6,572,435 | B1 * | 6/2003 | Wong | A63H 37/00 124/16 |
| 6,634,921 | B1 * | 10/2003 | Coulthard, Jr. | A63H 5/00 206/804 |
| 6,905,391 | B2 | 6/2005 | Soto et al. | |
| 7,347,762 | B1 | 3/2008 | Long | |
| 7,810,719 | B2 * | 10/2010 | Clegg | G06Q 20/363 235/375 |
| 7,922,557 | B2 | 4/2011 | Fearon et al. | |
| 7,963,278 | B2 * | 6/2011 | Makowski | F41B 15/10 124/41.1 |
| 8,821,209 | B2 | 9/2014 | Fong et al. | |
| 8,876,574 | B2 * | 11/2014 | Bourdelaise | A63H 37/00 446/399 |
| 8,887,420 | B2 * | 11/2014 | Nelson | A63H 33/38 40/124.03 |
| 9,409,100 | B2 * | 8/2016 | Hillery | A63H 37/00 |
| 2003/0104757 | A1 * | 6/2003 | Rasmussen | A63H 37/00 446/397 |
| 2008/0287034 | A1 * | 11/2008 | Baroni | A63H 5/00 446/397 |
| 2014/0287182 | A1 * | 9/2014 | Merdassi | A63H 37/00 428/44 |
| 2015/0352460 | A1 * | 12/2015 | Holmes | A63H 37/00 446/475 |

FOREIGN PATENT DOCUMENTS

| | | | |
|---|---|---|---|
| GB | 2255025 | A | 10/1992 |
| GB | 2277880 | A | 11/1994 |

* cited by examiner

CRACKER WITH VIEWING WINDOW

FIELD OF THE INVENTION

The present disclosure relates generally to party accessories, and more particularly to "Christmas crackers", otherwise known as party crackers or bon bans, poppers or crackers.

BACKGROUND OF THE INVENTION

A party favor is that known as a cracker, usually comprises a cylindrical container with appropriate contents, commonly a folded party hat, a metal charm, a short printed saying, poem, or the like commonly called a verse, and an explosive snapper strip which passes through the cylinder, with its ends projecting well beyond the ends of the cylinder. The cylinder is opaque and precludes a recipient from viewing the contents prior to destroying the cylinder.

BRIEF SUMMARY

In one aspect, a cracker is provided having a central body defining an internal chamber; a pair of opposing pull-formations frangibly connected to opposite ends of the central body, at least one pull-formation connected to the central body along a line of weakness; and the central body including a window frame exposing contents of the internal chamber to visible inspection.

In a further aspect, a windowpane is located within the window frame, wherein the windowpane precludes the passage of contents through the window frame.

It is also contemplated the window frame, or window frame and windowpane, have sufficient structural integrity to substantially preclude deformation or failure when subject to an opening force applied to the cracker.

BRIEF DESCRIPTION OF THE SEVERAL VIEWS OF THE DRAWING(S)

A preferred embodiment of the invention will now be described, by way of example only, with reference to the accompanying drawings in which.

DETAILED DESCRIPTION OF PREFERRED EMBODIMENTS

Figure 1:
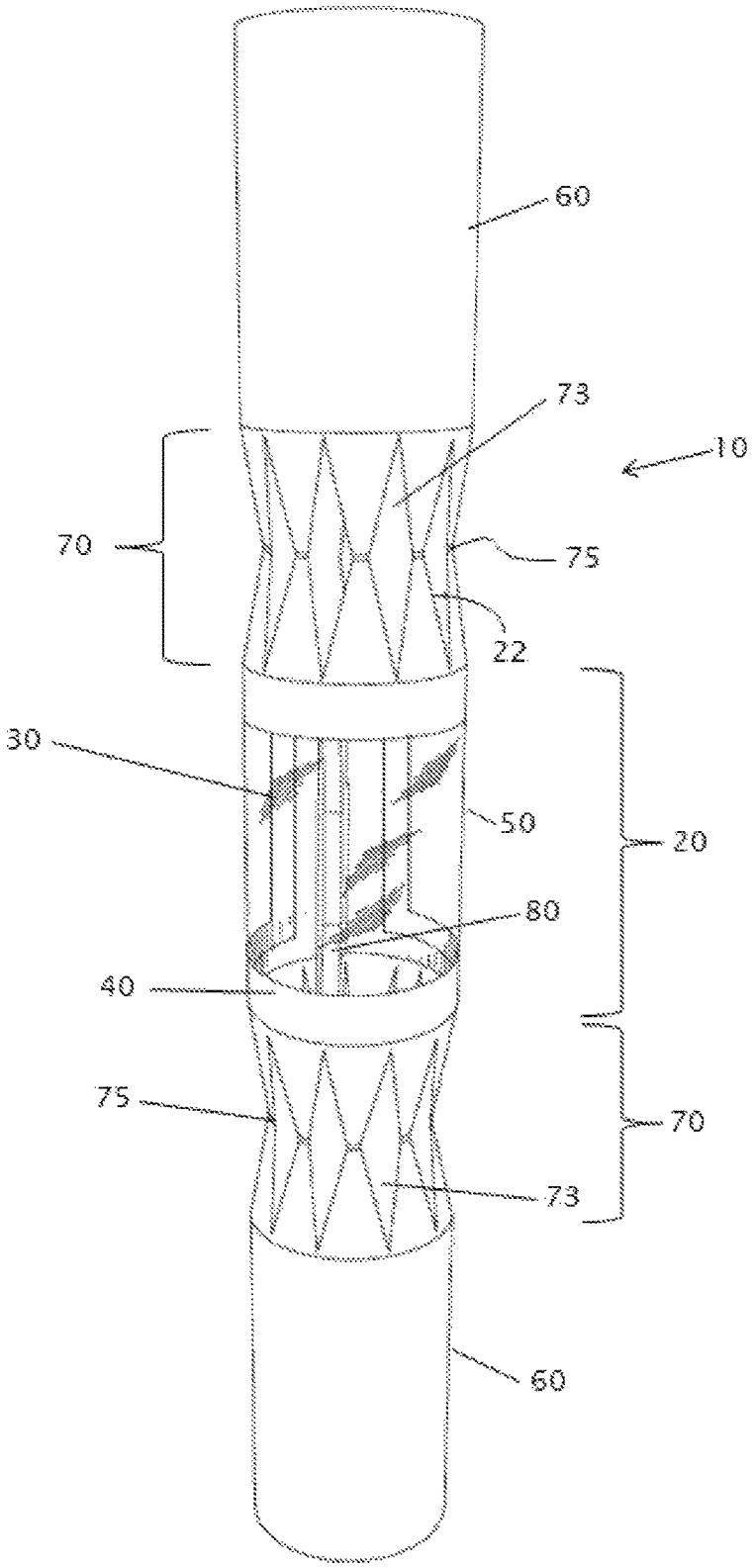
FIG. 1 is a perspective view of a cracker in a partially formed configuration.

Referring to the drawings, the present disclosure provides a cracker 10, having a central generally tubular central body 20, defining an internal chamber 30, and a pair of opposing pull-formations 60, joined to opposite ends of the central body by respective frangible connecting portions 70.

In one configuration, the central body 20, the pull-formations 60 and the connecting portions 70 are integrally formed from a single piece or blank of stock, such as but not limited to cardboard, paperboard, or paper-covered cardboard panel. However, it is understood at least one of the central body 20, the pull-formations 60 and the connecting portions 70 can be separately formed and subsequently attached to the remaining ones of the central body, the pull-formations and the connecting portions. For example, the central body 20 can be independently formed (constructed) and subsequently attached to the pull formations 60 at or by connecting portions 70. In one configuration, it is contemplated the interconnection of the separately formed central body 20 and pull formations 60 defines a line of weakness 75 between at least one of the pull formations and the central body. In a further construction, the interconnection of each pull formation 60 and the central body 20 defines a line of weakness 70.

In one configuration, the connecting portions 70 are defined by respective series of circumferentially spaced cut-outs 73 which define frangible fingers 22. Each series of cut-outs 73 defines a portion of a circumferential line of weakness 75 and also allows a radial contraction between the associated pull-formation 60 and the central body 20. The line of weakness 75 also provides for preferential separation or failure along the line.

The line of weakness 75 is any alteration in the structure along a predetermined path in one or more layers of the stock forming the cracker 10 that allows the stock to be preferentially folded, torn, separated, divided or otherwise manipulated along that path in a manner that was not possible without the line of weakness. The line of weakness 75 defines a required force to separate opposing sides of the line of weakness, such as the pull formation 60 from the central body 20 and thereby defines the force necessary to open the cracker 10 and access the contents. For purposes of description, this force is referred to as the separation force. Thus, at least a portion of the line of weakness 75 fails under the separation force.

A string tie can be used to contract the connecting portion 70, and thereby provides a neck 76 of reduced diameter at each end of the central body 20. Thus, each pull formation 60 is connected to the central body 20 by one neck. In one configuration, each neck 76 includes the line of weakness 75. In an alternative configuration, one neck 76 includes the line of weakness 75 and the remaining neck does not, thereby creating a preferential separation of the one pull formation 60 from the central body 20 while retaining the remaining pull formation with the central body.

Figure 2:
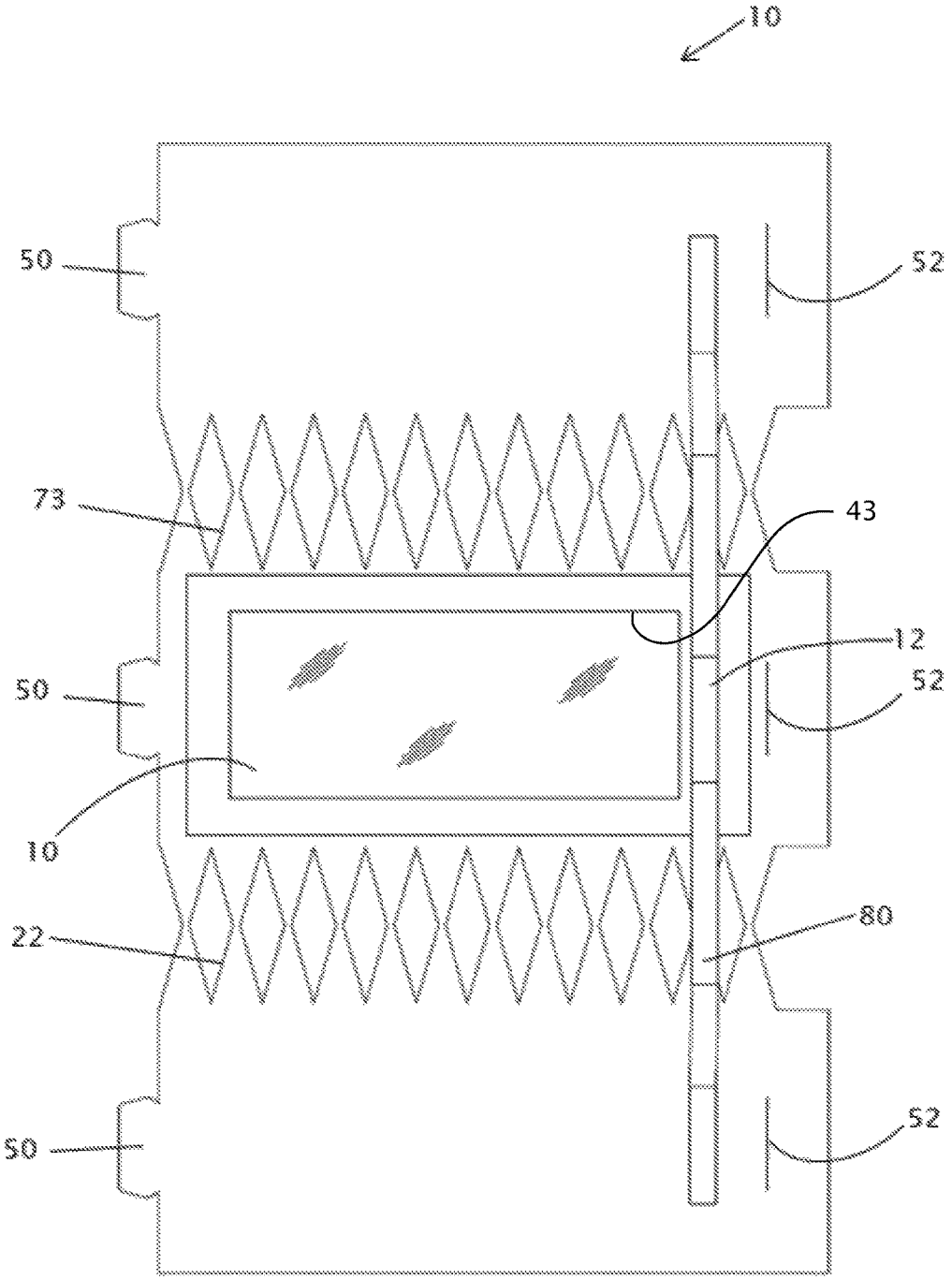
FIG. 2 is a blank for forming the cracker of FIG. 1.
Figure 3:
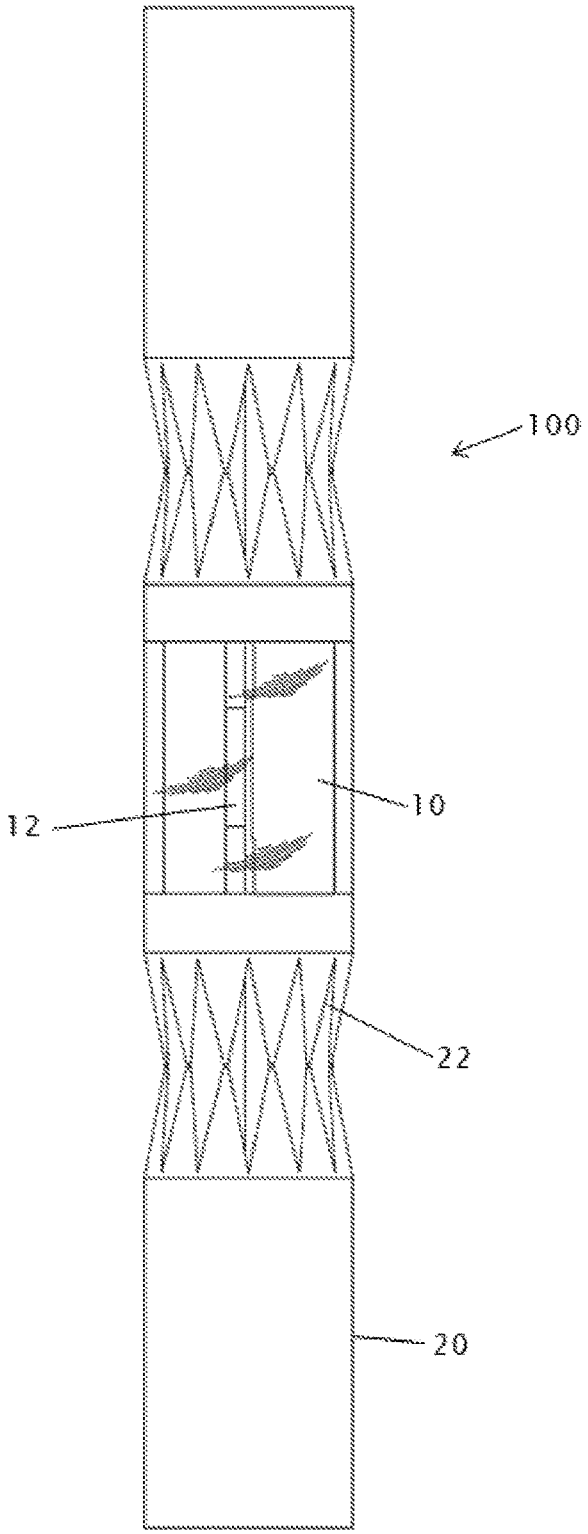
FIG. 3 is a front side elevational view of the cracker of FIG. 1.
Figure 4:
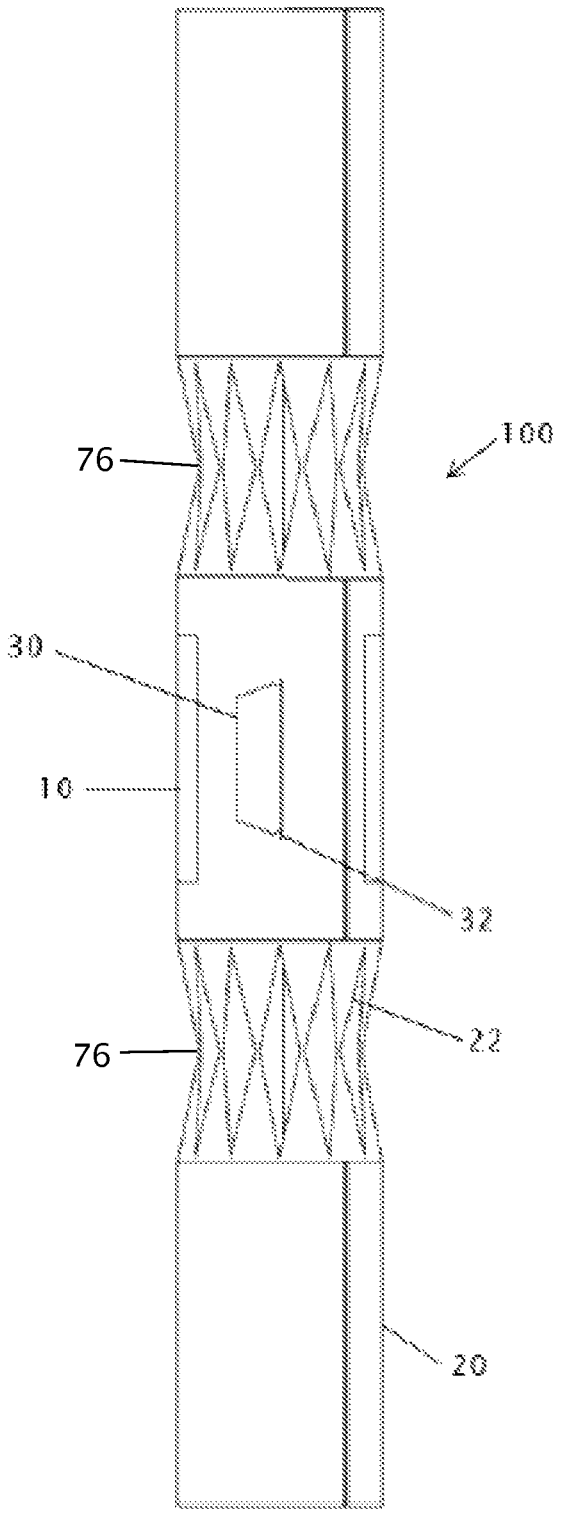
FIG. 4 is a rear side elevational view of the cracker of FIG. 1.
Figure 5:
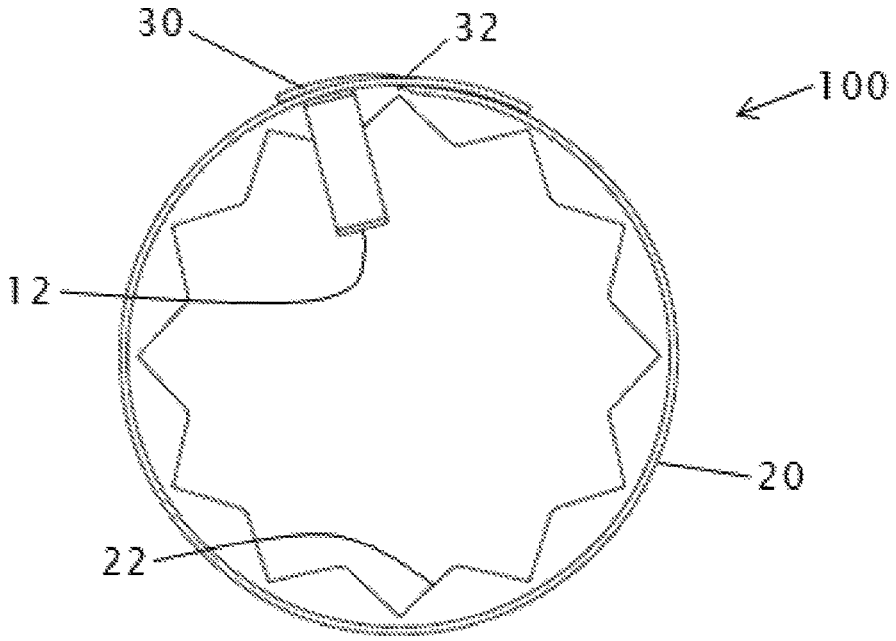
FIG. 5 is an end view of the cracker of FIG. 1.

As seen in FIGS. 1-3, the central body 20 includes a window frame 40 defining an opening or aperture 43 between the internal chamber 30 and an exterior of the cracker 10. The window frame 40 can have any of a variety of peripheries such as but not limited to square, rectangular, arcuate, curvilinear, scalloped, triangular or any other polygonal shape. The window frame 40 can define a single aperture 43 or a plurality of apertures that are from approximately 5% of the surface area of the central body to approximately 75% of the surface area of the central body 20.

The structure of the window frame 40 provides the window frame with a tear resistance greater than the separation force required to separate at least one of the pull formations 60 from the central body 20 along a line of weakness 75. That is, the force required to separate at least one of the pull formations 60 from the central body 20 is insufficient to tear or open the central body 20 along or about the window frame 40. Alternatively, the separation force required to cause at least a portion of the line of weakness 75 to fail is less than the destructive force necessary to tear or break the window frame 40. The window frame 40 defines sufficient structural rigidity to preclude destruction when subject to the separation force.

In terms of tear resistance, the window frame 40 has a tear resistance greater than a tear resistance of at least one of the lines of weakness 75.

The window frame 40 can define a single aperture 43 or a plurality of apertures. If a plurality of apertures are defined by the window frame 40, each apertures can be the same or different from remaining apertures. Thus, the apertures 43 can be of a same or different size. The apertures can be distributed about the formed central body 20 or within a given segment of the central body.

As set forth, above the window frame 40 is constructed to have a resistance to tearing greater than the separation force required to separate material along the line of weakness 75. Further, the window frame 40 is configured to sufficiently preclude deformation of the central body 20 (and window frame 40), at least during opening of the cracker 10. That is, the window frame 40 and the central body 20 do not deform in response to longitudinal force applied along the pull formations 60. While there may be distortion of the window frame 40 (and central body 20) in response to the longitudinal force applied along the pull formations, neither the window frame nor the central body so distorts that contents are then permitted to pass through the window frame.

In certain configurations, a windowpane 50 is located within the window frame 40. The windowpane 50 can be any of a variety of materials from transparent to translucent. For example, the windowpane 50 can be a thin, transparent sheet made of regenerated cellulose, or a polymer. It is also contemplated the windowpane 50 can include a frosted or "etched" image, wherein the image can correspond to a print design or color scheme of the central body 20.

At least one of the window frame 40 and the windowpane 50, or the combination of the window frame and the windowpane has a strength (resistance to separation/failure) that is greater than the line of weakness 75. That is, the separation force is insufficient to tear the window frame 40 or fracture or split the central body 20. Further, if the cracker 10 includes the windowpane 50, the windowpane remains in place under the longitudinal force. In one configuration, at least one of the window frame 40 and the windowpane 50 have a tear resistance greater than at least one of the lines of weakness 75.

As best seen in FIGS. 1 and 2, in one configuration of the cracker 10, the cracker further includes internal elongate activation strips 80 that extend inwardly from the respective pull-formations 60 and are detachably connected in an overlapping relationship within the internal chamber 30 of the central body 20. The activation strips 80 incorporate friction tabs and a minute quantity of an explosive, such as gun-powder, in the overlapping zone.

In one configuration, the outer ends of the activation strips 80 are secured to the respective pull-formations 60, so that the cracker 10 will operate effectively without the pull-formations or activation strips needing to be held or gripped in any particular way by the users. However, it is understood that this feature is optional, and that in alternative embodiments, the outer ends of the activation strips 80 may simply rest within the respective pull-formations 60 without being secured, in which case reliable activation is dependent upon the users gripping the activation strips in conjunction with the respective pull-formations.

The cracker 10 can be constructed by cutting or forming a blank having the corresponding periphery and window frame 40, and subsequently shaping the blank into the final cylindrical shape.

In cutting or forming of the blank, the window frame 40 and cutouts 73 of the connection regions 70 are created. Depending on the specific manufacturing process, the windowpane 50 can be affixed to the blank prior to cutting or after cutting.

The cut blank is then rolled into a tube with overlapping longitudinal edges joined together along an adhesion line or mechanical interconnect such as tab(s) 50 and slot(s) 52. That is, the overlapping edges of the rolled blank can be joined by means of double-sided adhesive tape, but may alternatively be joined by gluing, interlocking flaps or tabs, stapling, stitching, single side tape or other suitable means.

One end of the central body is closed off by the string tie reducing the diameter of the cylinder in the region of the cut-outs 73 to form the neck 76.

Prior to formation of the neck 76 at each end of the central body 20, the desired contents are introduced into the internal chamber 30. In one configuration, the contents are sized to pass through the cylinder of the central body 12, but are too large to pass through the window frame 40. If a windowpane 50 is located in the window frame 40, then the contents can be smaller or larger than the aperture of the window frame. Further, the contents can be partly wrapped, fully wrapped or unwrapped, so that an inspection through the window frame 40 identifies, gives clues or no clues about the specific content. For example, if the contents are individually wrapped these wrapped presents are visible through the window frame 40 and windowpane 50 and can thus be subject to an overall color or decoration theme between the cracker 10 and the contents.

Once the contents have been disposed within the internal chamber 30 of the central body 20, the remaining neck 76 is formed (or both necks, if one neck has not yet been formed). The cracker 10 is then ready for distribution or use.

When a tensile longitudinal force is applied to the pull-formations 60 along the cracker 10, such as the cracker is pulled from both ends with sufficient force, one of the pull-formations (if both necks have a line of weakness 75) randomly detaches and is separated from the central body 20, whereby the activation strips 80 also become separated from one another.

Alternatively, if only one neck 76 includes the line of weakness 75, then the corresponding pull-formation 60 is separated from the central body 20, and the contents are accessible.

During the separation process of the pull formation 60 from the central body 20, relative sliding movement of the overlapping friction tabs detonates the explosive, to produce a harmless but strongly audible "bang", which is intended to heighten the sense of celebration and surprise.

The present disclosure provides a simple and reliable cracker 10, which provides a visual inspection or access to the contents of the central body. Contents of the internal chamber 30 can be separately or individually wrapped. Alternatively, the contents can be unwrapped and thus readily identifiable by viewing through the window frame 40 and windowpane 50, if employed.

Although the present configurations have been described with reference to specific examples, it will be appreciated by those skilled in the art that the claimed invention can be embodied in many other forms.

The invention claimed is:

1. A cracker comprising:

(a) an opaque central body having a first end and a second end, the central body defining an internal chamber having a given diameter, the central body including a window frame defining an opening in the central body, the window frame exposing contents of the internal chamber to visible inspection;

(b) a first pull-formation frangibly connected to the first end of the central body and a second pull-formation frangibly connected to the second end of the central body opposite the first end, each pull-formation connected to the central body at a neck, the neck having a neck diameter that is less than the given diameter, at least one pull-formations connected to the central body along a line of weakness; and (c) a transparent windowpane connected to the window frame, the windowpane inhibiting the passage of contents through the window frame;

wherein (i) the windowpane has a tear resistance greater than at least one of the lines of weakness, (ii) the window frame has a tear resistance greater than at least one of the lines of weakness and (iii) the central body and the first and the second pull-formations are integrally formed from a single blank.

2. The cracker of claim 1, wherein the line of weakness is a preferential tear line.

3. The cracker of claim 1, wherein the window frame defines a plurality of apertures, each of the plurality of apertures sized to preclude passage of contents through the apertures.

4. The cracker of claim 1, wherein the neck includes a plurality of fingers.

5. The cracker of claim 1, wherein the neck includes a plurality of fingers and the plurality of fingers include the frangible connection.

6. The cracker of claim 1, wherein the neck includes a plurality of cutouts.

7. The cracker of claim 1, further comprising an activation strip extending through the body between the pull-formations.

8. The cracker of claim 1, wherein both the windowpane and the window frame have a tear resistance greater than each of the lines of weakness.

9. A cracker comprising:

(a) an opaque central body defining an internal chamber and having a given diameter, the central body including a window frame exposing contents of the internal chamber to visible inspection;

(b) a first pull-formation frangibly connected to a first end of the central body at a first neck and a second pull-formation frangibly connected to an opposite end of the central body at a second neck, each of the first neck and the second neck having a first configuration having a neck diameter of the given diameter and a second configuration having a neck diameter that is less than the given diameter, at least one pull-formations connected to the central body along a line of weakness; and (c) a transparent windowpane in the window frame, the windowpane inhibiting the passage of contents through the window frame;

wherein (i) at least one of the windowpane and the window frame has a tear resistance greater than at least one of the lines of weakness and (ii) the central body and the first and the second pull-formations are integrally formed from a single blank.

* * * * *